US006618568B2

(12) United States Patent
Pang et al.

(10) Patent No.: US 6,618,568 B2
(45) Date of Patent: Sep. 9, 2003

(54) IMAGE FUSING UNIT OF LIQUID ELECTROPHOTOGRAPHIC PRINTER

(75) Inventors: Jeong-hun Pang, Gyeonggi-do (KR); Dong-hwan Kang, Gyeonggi-do (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 10/079,571

(22) Filed: Feb. 22, 2002

(65) Prior Publication Data

US 2003/0035662 A1 Feb. 20, 2003

(30) Foreign Application Priority Data

Aug. 16, 2001 (KR) ..... 2001-49315

(51) Int. Cl.[7] ..... G03G 15/11; G03G 15/20

(52) U.S. Cl. ..... 399/251; 399/328; 399/397

(58) Field of Search ..... 399/341, 335, 399/322, 320, 251, 67, 328, 397

(56) References Cited

U.S. PATENT DOCUMENTS 4,780,742 A * 10/1988 Takahashi et al. ..... 399/320
4,903,082 A * 2/1990 Dyer et al. ..... 399/320
5,025,292 A * 6/1991 Steele ..... 399/251
5,150,161 A * 9/1992 Bujese ..... 399/328
5,164,782 A * 11/1992 Nagayama et al. ..... 399/320
5,495,324 A * 2/1996 Kopp ..... 399/328
5,983,048 A * 11/1999 Moser ..... 399/67
6,418,289 B1 * 7/2002 Kleckner et al. ..... 399/251
2001/0043821 A1 * 11/2001 Okamoto ..... 399/251

* cited by examiner

*Primary Examiner*—Susan S. Y. Lee
(74) *Attorney, Agent, or Firm*—Sughrue Mion, PLLC

(57) ABSTRACT

An image fusing unit of a liquid electrophotographic unit for fusing an image developed by a developer which is a mixture of toner particles and liquid solvent and transferred onto a sheet of paper includes a charging portion installed on a transfer path of the paper for applying electric potential in a direction in which the toner is in close contact with the paper, a drying portion for drying the image by directly contacting and heating the paper, and a fusing portion for fixing the image to the paper by heating and pressing the paper. Thus, the efficiency of heat can be improved by drying in the direct contact method. Also, by closely pressing the toner against the paper prior to drying, the disadvantage according to the contact type drying method, that is, the toner adheres to a contact member, can be solved.

7 Claims, 1 Drawing Sheet

IMAGE FUSING UNIT OF LIQUID ELECTROPHOTOGRAPHIC PRINTER

BACKGROUND OF THE INVENTION

1. Field of the Invention

An apparatus consistent with the present invention relates to an image fusing unit of a liquid electrophotographic printer.

2. Description of the Related Art

In a typical liquid electrophotographic printer such as a color laser printer, a desired image is developed on a photosensitive medium with a developer liquid mixture of charged toner particles and solvent, and then, the developed image is transferred to a sheet of print paper.

However, since the image transferred onto the print paper includes a large amount of solvent, an image fusing unit is needed to dry the image after transfer and completely fuse it on the print paper.

FIG. 1 shows a conventional image fusing unit for drying and fusing which is disclosed in U.S. Pat. No. 5,465,146. As shown in the drawing, the image fusing unit includes a drying portion 1 for drying a sheet of paper C where an image C1 is transferred in a non-contact manner, and a fusing portion 2 for fusing the image C1 by heating and pressing the paper C. The drying portion 1 includes a first roller R1 where a heater H1 is built in, a drying belt B circulating between the first roller R1 and a second roller R2. The fusing portion 2 includes the second roller R2 and a third roller R3 where a heater H2 is built in and rotating in contact with the second roller R2.

In the above structure, the paper C transferred to the image fusing unit through a transfer belt T is heated and dried while passing through the drying portion 1. That is, heat generated from the heater H1 of the first roller R1 heats the drying belt B and the paper C passing under the drying belt B receives radiant heat of the heated drying belt B. This heat dries the image C1 on the paper C and the solvent included in the image C1 is vaporized and thus removed. Then, the paper C is heated and pressed as it passes between the second roller R2 and third roller R3 of the fusing portion 2, so that the image C1 which is previously dried is completely fused on the paper C.

However, in the image fusing unit having the above structure, since the drying portion 1 is configured in a non-contact heating manner, the efficiency of heat in the drying work is low. That is, since the paper C is heated in a non-contact manner through the radiant heat of the drying belt B heated by the heater H1, even when the temperature of the surface of the drying belt B is high, the temperature of the surface of the paper C heated thereby is quite low as compared to that of the drying belt B. Thus, in order to obtain a desired degree of dryness by increasing the temperature of the paper C to a predetermined level, since the temperature of the heater H1 must be much higher than the predetermined level, much energy is consumed accordingly. To solve the problem, the paper C is preferably dried in a contact manner. In this case, however, since an image which is not sufficiently dried needs to be contacted, the image may be damaged during a drying step. Therefore, an image fusing unit having an improved structure to solve the above problem is required.

SUMMARY OF THE INVENTION

To solve the above-described problems, it is an aspect of the present invention to provide an improved image fusing unit of a liquid electrophotographic printer which can restrict damage to an image while increasing the efficiency of heat during image drying.

To achieve the above aspect, there is provided an image fusing unit of a liquid electrophotographic unit for fusing an image developed by a developer, which is a mixture of a toner and a liquid solvent, and transferred onto a sheet of paper, the image fusing unit comprises a charging portion installed on a transfer path of the paper and which applies electric potential in a direction in which the toner is in close contact with the paper, a drying portion which dries the image by directly contacting and heating the paper, and a fusing portion which fixes the image to the paper by heating and pressing the paper.

BRIEF DESCRIPTION OF THE DRAWINGS

The above aspects and advantages of the present invention will become more apparent by describing in detail illustrative, non-limiting embodiments thereof with reference to the attached drawings, in which.

DETAILED DESCRIPTION OF ILLUSTRATIVE EMBODIMENTS OF THE INVENTION

Figure 1:
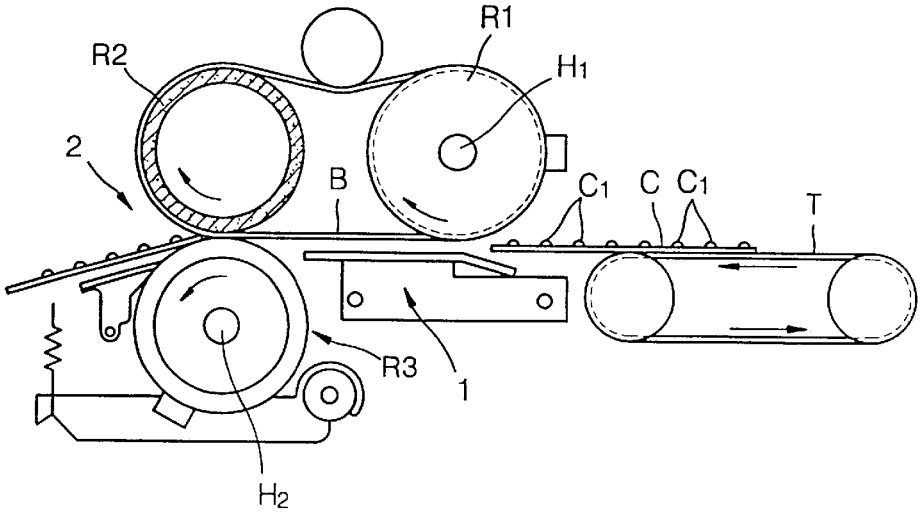
FIG. 1 (PRIOR ART)
FIG. 1 is a view of an image fusing unit of a conventional liquid electrophotographic printer.
Figure 2:
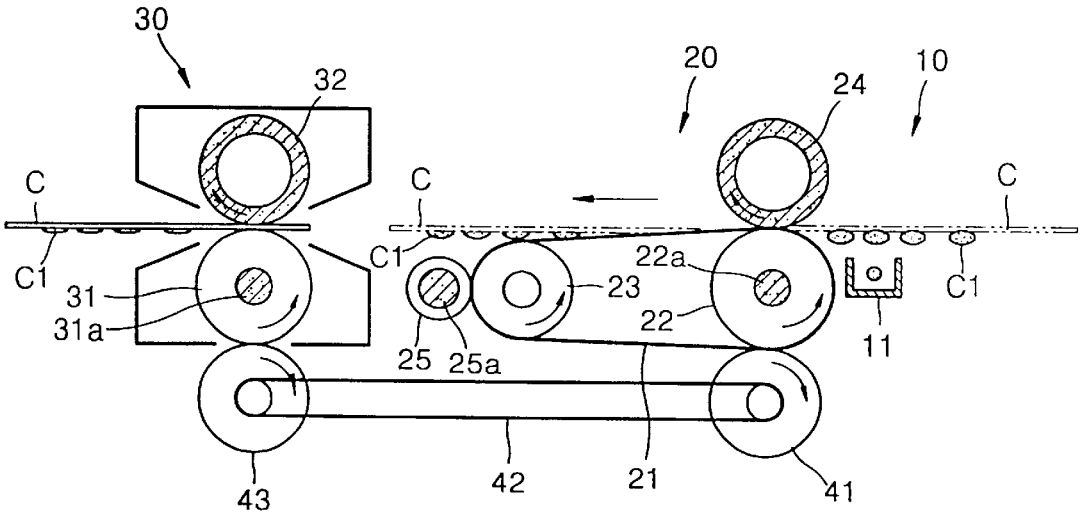
FIG. 2 is a view of an image fusing unit of a liquid electrophotographic printer according to the present invention.

Referring to FIG. 2, an image fusing unit of a liquid electrophotographic printer according to an illustrative, non-limiting embodiment of the present invention includes a charging portion 10, a contact type drying portion 20, and a fusing portion 30. The charging portion 10 includes a charger 11 for forming electric potential on a path along which a sheet of paper C passes. The charger 11 forms an electric potential in a direction in which an image C1 of a developer transferred onto the paper C is pressed against the paper C. That is, since toner in the developer is typically charged to plus (+), as shown in the drawing, the surface of the paper C where the image C1 is transferred is charged to be relatively higher than the opposite surface thereof so that the toner is in close contact with the paper C by an electric force. This corresponds to a preliminary pressing step to prevent the toner from adhering to a drying belt 21 when the paper C passes through a contact type drying portion 20 which is described below.

The drying portion 20 includes the drying belt 21 endlessly circulating between a drying roller 22 and a support roller 23, a backup roller 24 rotating by being in close contact with the drying belt 21, a heater 22*a* included in the drying roller 22, and a regeneration roller 25 including another heater 25*a* for vaporizing solvent absorbed in the drying belt 21 by contacting the drying belt 21. Thus, the paper C passing the charging portion 10 passes between the drying belt 21 and the backup roller 24 and dried by directly contacting the drying belt 21 heated by the heater 22*a* of the drying roller 22. In this case, part of the solvent included in the image formed on the paper C is vaporized by receiving the heat from the drying belt 21 and part thereof is removed by being absorbed by the drying belt 21. For this purpose, the drying belt 21 is preferably, but not necessarily, formed by coating silicon on a metallic substrate so that the solvent can be easily absorbed by the coating layer. The drying roller 22 and the regeneration roller 25 can be formed to be an aluminum roller coated with silicon. The backup roller 24 can be formed to be a silicon foamed conductive roller.

The fusing portion 30 includes a fusing roller 31 having a built-in heater 31*a,* and a backup roller 32 rotating in close contact with the fusing roller 31 and passing the paper C therebetween. Thus, the paper C passing through the drying portion 20 is heated and pressed while passing between the fusing roller 31 and the backup roller 32 and the image C1 is completely fixed to the paper C. The fusing roller 31 may be an aluminum roller coated with TEFLON and the backup roller 32 may be a silicon foamed conductive roller.

Reference numeral 41 denotes a drive roller for driving the drying roller 22. reference numeral 43 denotes a driven roller for driving the fusing roller 31 by receiving power of the drive roller 41 via a power transfer belt 42.

When a print job is performed, the paper C where the image C1 is transferred enters the image fusing unit after the developing and transferring steps. First, when the paper C enters the charging portion 10, the toner forming the image C1 is forced to contact the paper C more closely by the electric potential of the charger 11.

Next, the paper C passes between the drying belt 21 and the backup roller 24 of the drying portion 20. At this stage, the solvent included in the image C1 is absorbed by the drying belt 21 and part of the solvent is vaporized by the heat generated from the heater 22*a* of the drying roller 22. That is, since the drying work is performed by directly contacting the paper C, the efficiency of transfer of heat to the paper C is superior and an effect of removing through absorption can be achieved. As the toner is pressed more closely to the paper C in the charging portion 10, a phenomenon in which the toner adheres to the drying belt 21 is restricted. Also, the solvent absorbed by the drying belt 21 is heated by the heater 25*a* of the regeneration roller 25 and vaporized. Thus, the drying belt 21 continues to absorb the solvent.

The paper C dried as described above finally passes through the fusing portion 30. At this stage, the paper C is heated and pressed between the fusing roller 31 and the backup roller 32 so that the image C1 is completely fixed to the paper C. The paper C where the image C1 is fixed is exhausted through an outlet (not shown) of the printer along a predetermined path. Thus, the image fusing unit can provide a superior efficiency of heating as heat is applied in a state of directly contacting the paper in the drying portion, and an effect of removing solvent by absorption. Also, since the toner is pressed closer to the paper in the charging portion, the toner is prevented from adhering to the drying belt during the drying step although it is a contact type drying method.

As described above, in the image fusing unit of a liquid electrophotographic printer according to the present invention, the efficiency of heat can be improved by drying in the direct contact method. Also, by closely pressing the toner against the paper prior to drying, the disadvantage according to the contact type drying method, that is, the toner adheres to a contact member, can be solved.

It is contemplated that numerous modifications may be made to the image fusing unit of a liquid electrophotographic printer of the present invention without departing from the spirit and scope of the invention as defined in the following claims.

What is claimed is:

1. An image fusing unit of a liquid electrophotographic unit for fusing an image developed by a developer, which is a mixture of a toner and a liquid solvent, and transferred onto a sheet of paper, the image fusing unit comprising:

a charging portion installed on a transfer path of the paper and which applies electric potential in a direction in which the toner is in close contact with the paper;

a drying portion which dries the image by directly contacting and heating the paper; and a fusing portion which fixes the image to the paper by heating and pressing the paper.

2. The image fusing unit as claimed in claim 1, wherein the drying portion comprises:

a drying belt arranged on the transfer path of the paper to contact the paper and supported by a plurality of rollers to circulate in an endless path;

a heater for heating which is included in at least one of the rollers for supporting the drying belt; and a backup roller rotating in contact with the drying belt and allowing the paper to pass between the backup roller and the drying belt.

3. The image fusing unit as claimed in claim 2, wherein the drying portion further comprises a regeneration roller including a heater and rotating in contact with the drying belt to vaporize the liquid solvent absorbed therein.

4. The image fusing unit as claimed in claim 2, wherein the drying belt comprises silicon coated on a metallic substrate.

5. The image fusing unit as claimed in claim 1, wherein the fusing portion comprises:

a pair of rollers rotating in contact with each other and allowing the paper to pass between the rollers; and a heater for heating which is included in at least one of the rollers.

6. The image fusing unit as claimed in claim 2, further comprising a drive roller which drives one of the rollers for supporting the drying belt.

7. The image fusing unit as claimed in claim 6, further comprising a power transfer belt and a driven roller, wherein the fusing portion includes a heated fusing roller which is driven by the driven roller by receiving power from the drive roller via the power transfer belt.

* * * * *